US005833486A

United States Patent [19]

Shinozaki

[11] Patent Number: 5,833,486

[45] Date of Patent: Nov. 10, 1998

[54] PRESS-CONTACT CONNECTOR

[75] Inventor: Tetsuya Shinozaki, Yokkaichi, Japan

[73] Assignee: Sumitomo Wiring Systems, Ltd., Japan

[21] Appl. No.: 745,616

[22] Filed: Nov. 7, 1996

[30] Foreign Application Priority Data

Nov. 7, 1995 [JP] Japan ..... 7-314644

[51] Int. Cl.[6] ..... H01R 4/26

[52] U.S. Cl. ..... 439/404; 439/494

[58] Field of Search ..... 439/397, 399, 439/401, 404–407, 494

[56] References Cited

U.S. PATENT DOCUMENTS

| | | | |
|---|---|---|---|
| 4,083,615 | 4/1978 | Volinskie | 439/405 |
| 4,995,828 | 2/1991 | Goodman et al. | 439/405 |
| 5,129,840 | 7/1992 | Kuzono et al. | 439/405 |
| 5,226,835 | 7/1993 | Baker, III et al. | 439/403 |
| 5,536,182 | 7/1996 | Atoh et al. | 439/404 |
| 5,601,447 | 2/1997 | Reed et al. | 439/404 |
| 5,643,005 | 7/1997 | Weidler et al. | 439/405 |

FOREIGN PATENT DOCUMENTS

| | | |
|---|---|---|
| 0006100 | 1/1980 | European Pat. Off. . |
| 0605200 A2 | 7/1994 | European Pat. Off. . |

*Primary Examiner*—Neil Abrams
*Assistant Examiner*—Brian J. Biggi
*Attorney, Agent, or Firm*—Banner & Witcoff, Ltd.

[57] ABSTRACT

An electrical connector (10) has electrical cables (50) pressed into channels (19) to connect the cables by pressure crimping to a respective terminal (43); the channels are aligned in a common plane to facilitate crimping. Some of the terminals (43) are bent in the vertical or horizontal plane, or both, so that the connection portions (44) of the terminals are arranged in several planes to suit a standard kind of mating connector.

17 Claims, 11 Drawing Sheets

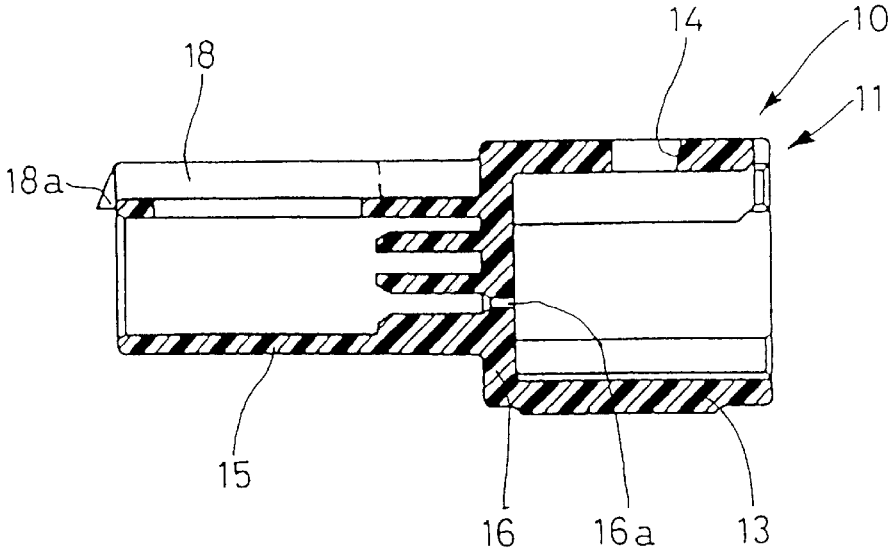
FIG. 4
FIG. 5
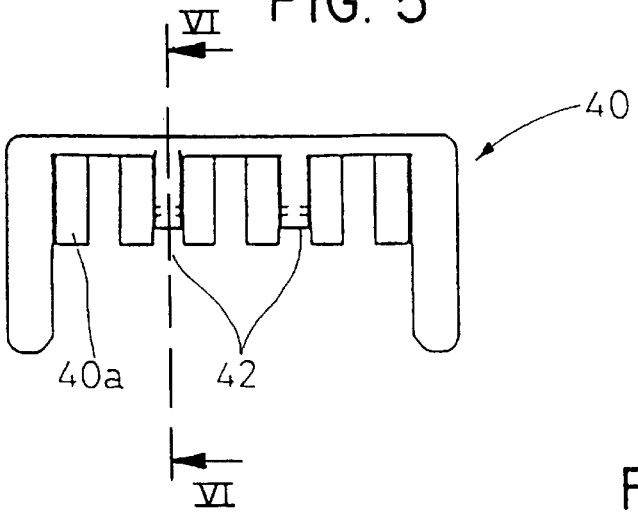
FIG. 6
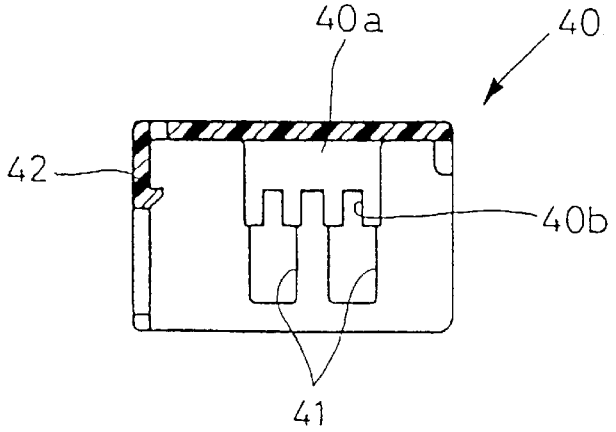

FIG. 19
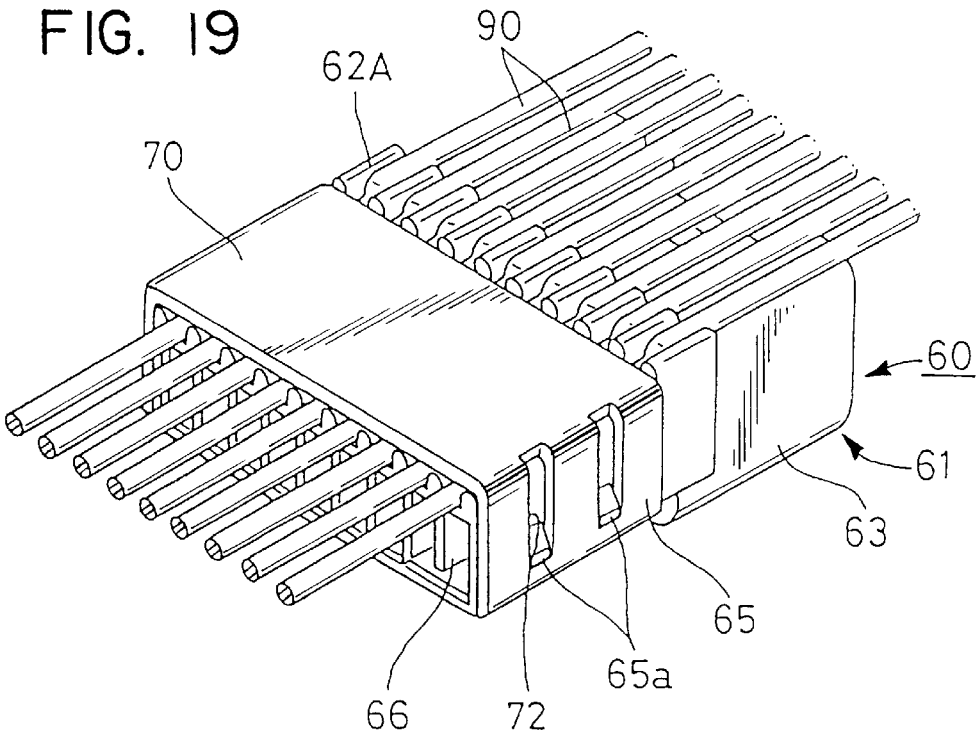
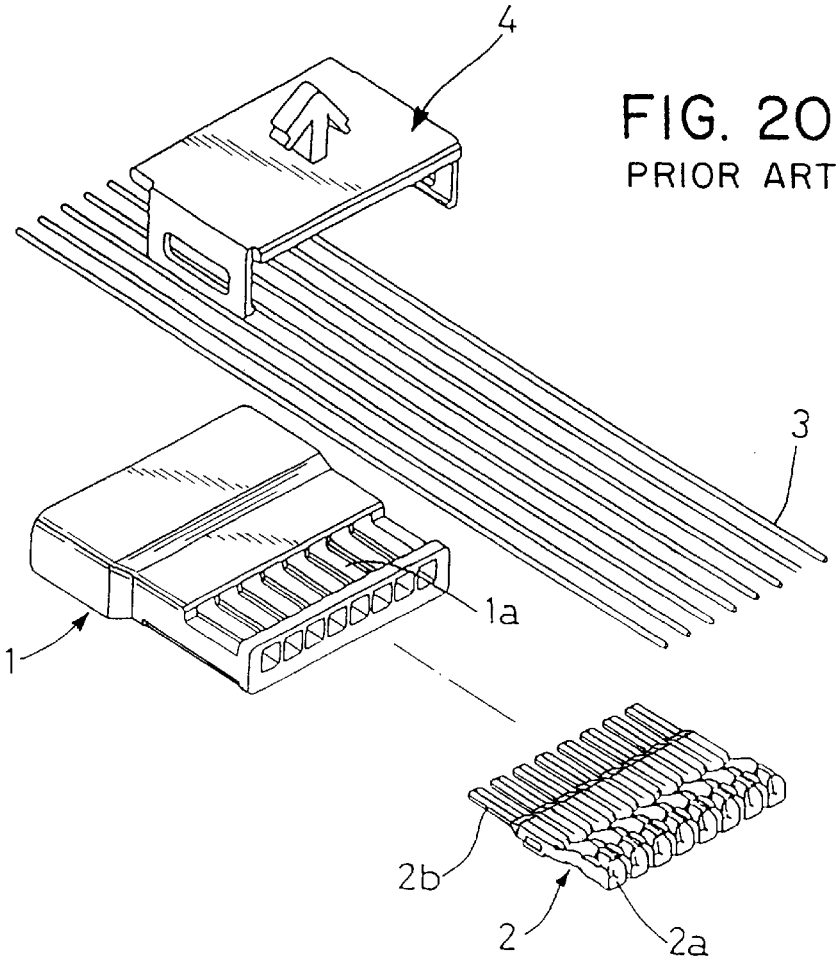
FIG. 20
PRIOR ART

PRESS-CONTACT CONNECTOR

The present invention relates to a pressure crimping connector which crimps and electrically connects insulated electric wires to terminal fittings.

DESCRIPTION OF THE PRIOR ART

An example of the kind of pressure crimping connector considered here is described, for example, in Laid-Open Publication Jikkaihei 6-54214. As shown in FIG. 20 of this specification, this kind of connector allows the insertion of a plurality of terminal fittings 2 arranged in a parallel manner into cavities located inside the connector housing 1. The terminal fittings 2 have connection members 2*b* which protrude into the hood of the connector housing 1. The connection members 2*b* connect with the corresponding connector. Moreover, a pressure crimping member 2*a* for connection to an insulated electric wire 3 by pressure crimping is exposed to the exterior by means of openings 1*a* formed in the connector housing 1.

According to this configuration, in order to connect the electric wires 3, each electric wire 3 must be arranged to be parallel with respect to the cavities and the portions thereof corresponding to the openings are pushed so as to be forced into the slits of the pressure crimping members 2*a*. Thereafter, a cover 4 is attached. By doing this, there is an advantage in that the extra labour involved in, for example, shaving off the insulating covering of the electric wire 3 and press crimping these to the terminal fittings is done away with since the pressure crimping member 2*a* of the terminal fitting 2 connects with the core of the electric wire 3 by cutting through the insulating cover of the electric wire 3 in the manner of a V-shaped blade.

However, in the case of the conventional technology described above, there is a problem in that it is not possible to make the terminal fittings 2 more compact by arranging them at a plurality of vertically spaced levels, as is done in the case of a normal connector. If the terminal fittings 2 are arranged in vertically spaced levels, only the pressure crimping members 2*a* located in the highest row allow the electric wires 3 to be pushed in, since the lower rows are obscured.

For this reason, in the conventional case where, for example, the terminal fittings 2 are arranged in two levels, the terminal fittings 2 are arranged so as to be mutually staggered. That is, it becomes necessary to have a so-called zigzag arrangement and if the requisite number of circuits are provided for this arrangement, there is a disadvantage in that the width-wise dimension of the connector as a whole increases, and the connector is in any event 'special' and not suited for connection to conventional kinds of connector.

Moreover, apart from this kind of problem, the following problem has also been pointed out. When the pressure crimping operation is carried out, the plurality of electric wires must be maintained in a parallel manner with respect to the housing. If this is not done, the electric wires may become scattered leading to crimping difficulties.

The present invention has been developed after taking into consideration the above problems in the conventional case and one of its aims is to provide a pressure crimping connector wherein electric wires can be connected by pressure crimping and the terminal fittings thereof are arranged in a plurality of levels, thereby achieving compactness; another aim is to present a pressure crimping connector wherein the electric wires can be temporarily supported when the pressure crimping operation of the electric wires is to be carried out.

SUMMARY OF THE INVENTION

According to the invention there is provided a connector comprising a housing and a plurality of terminals received in the housing, the terminals comprising an elongate first portion for making contact with another connector, and an elongate second portion having an upstanding slot to receive an electrical conductor by pressure crimping, the first and second portions being substantially parallel, characterised in that a first terminal further comprises a medial portion between the first and second portions thereof and substantially transverse with respect thereto, such that the first and second portions of said first terminal are non-linear; and a second terminal comprises co-linear first and second portions.

In such a connector the medial portions permit the terminals of a multi-terminal connector to be arranged on several levels, and at a spacing which will suit mating connector of a conventional kind. The arrangement nevertheless permits all of the wires to be aligned and press crimped in one operation.

In one embodiment the first, second and medial portions are co-planar giving a horizontally or vertically shifted terminal. Alternatively the terminal can be both horizontally and vertically shifted to give a non-aligned, non-coplanar construction. The terminal may be shifted two or more units to the side up or down in a multi-terminal connector.

Preferably the housing substantially surrounds the terminal to give insulation but has an elongate aperture over the second portion to facilitate press crimping. The aperture preferably has upstanding outwardly extending walls to retain a wire in position prior to press crimping. The spacing of the walls is advantageously only slightly more than the diameter of the wire to be crimped. The walls may extend beyond either end of the elongate aperture to support the wire after crimping.

A cover may be provided for the terminals and in particular the crimping apertures in a housing. The cover may be a plastics moulding which snap-fits into place using conventional lug and aperture fastener arrangement. The cover may have depending cleats to hold a wire in the crimped condition, and such cleats help to support the wire against end loads applied thereto.

Preferably the terminals of a multi-terminal connector are contained in adjacent chambers and separated by a partition wall. The wall may be slotted to permit assembly of a terminal of the present invention. Such a construction is particularly advantageous where the housing is a plastics moulding. Several such partition walls may be slotted to suit terminals which are offset by two or more units. Moreover the same slot may be utilised by several terminals provided that the medial portions do not coincide.

DESCRIPTION OF THE DRAWINGS

FIG. 4 is a cross-sectional view of the housing along line IV—IV indicated in FIG. 3;

FIG. 5 is a rear view of a cover of the connector shown in FIG. 1;

FIG. 6 is a cross-sectional view of the cover along line VI—VI indicated in FIG. 5;

FIG. 19 is a perspective view of the connector of FIG. 9 in an assembled state and having wires installed therein and FIG. 20 is a perspective view of a conventional connector.

DESCRIPTION OF THE PREFERRED EMBODIMENTS

Figure 1:
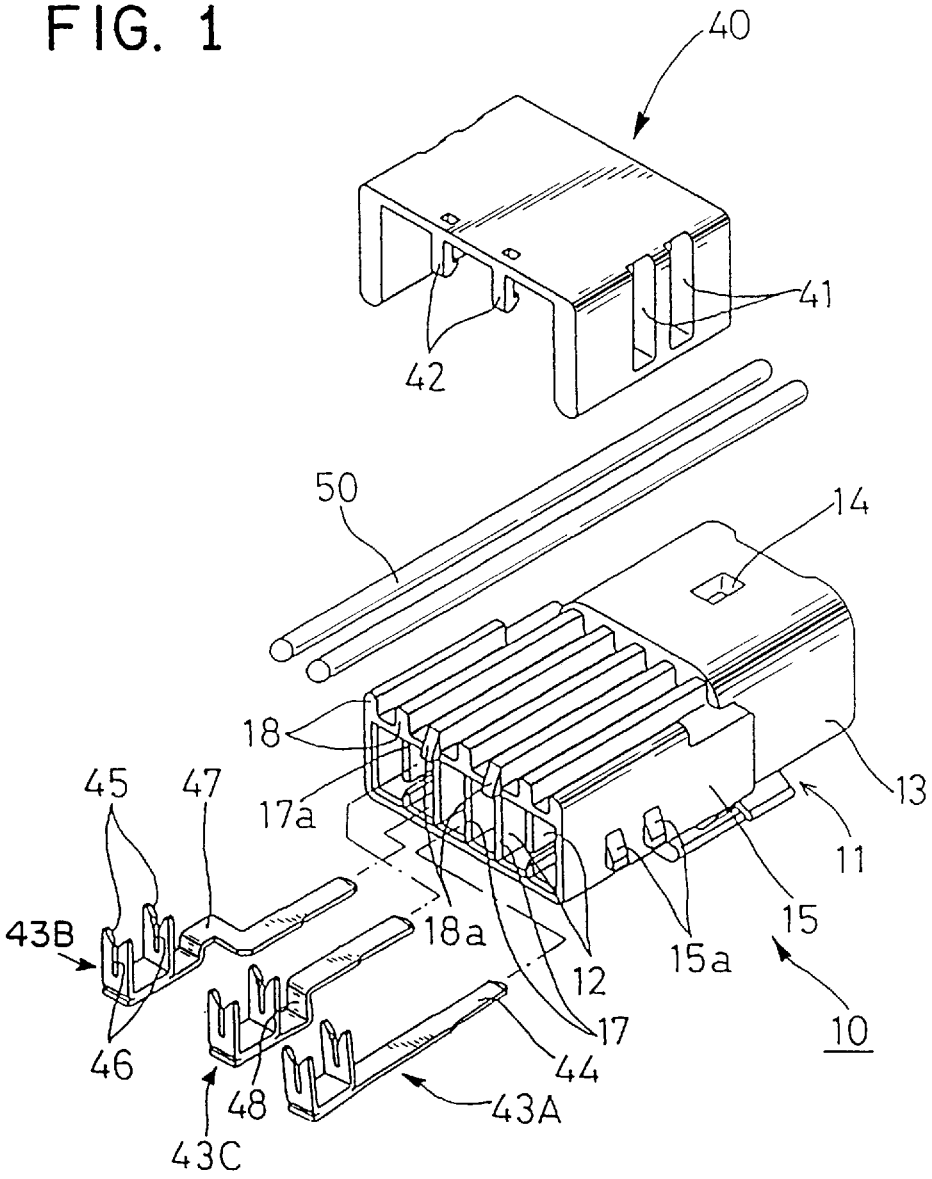
FIG. 1 is a perspective view of a connector according to a first embodiment of the invention in an exploded state.

FIGS. 1 to 8 show a first embodiment of the present invention. In this case, the application to a six-terminal pressure crimping connector (male connector) is discussed. As shown in FIG. 1, a connector 10 allows the insertion of six pressure crimping terminals 43 into cavities 12 formed in a connector housing 11 (referred to hereinafter simply as housing). Six electric wires 50 are arranged to be fixed by pressure crimping at a medial position in the connector 10.

The housing 11 is made uniformly from plastics material, by for example moulding, and a clip 20 is formed so as to project downwardly from its lower face. The clip 20 serves to fix the housing (see FIG. 2) by insertion into an attachment hole of a fixing wall face (not shown). A pair of fitting members 21 is formed at the lower end of an axial member so as to project diagonally upwards. The fitting members 21 bend and enter the attachment hole, and their extreme ends have claw members 21*a* formed thereon that fix with the attachment hole. Moreover, a pair of spring members 22 is formed at the upper end of the axial member so as to project in a downward direction, opposite to the direction of projection of the two fitting members 21. A spring force is thus applied at the periphery of the attachment hole during attachment, and the fit of the claw members 21*a* with the attachment hole is thereby strengthened.

A hood 13, formed so as to be tubular in shape, is provided at the anterior end of the housing 11. This permits the fitting of female connectors (not shown), resulting in corresponding male and female terminal fittings being electrically connected when in the fitted state. Moreover, a locking hole 14 is provided in the central portion on the upper face of the hood 13 for allowing the fitting of the locking mechanism of the female connector.

A terminal insertion member 15 is formed on the posterior end of the connector housing 11. The terminal insertion member 15 serves to house pressure crimping terminal fittings, to be described later, and is partitioned at the boundary with the hood 13 by means of a partition plate 16 (see FIG. 4). This partition plate 16 has through holes 16*a* corresponding to each of the terminal fittings.

Figure 2:
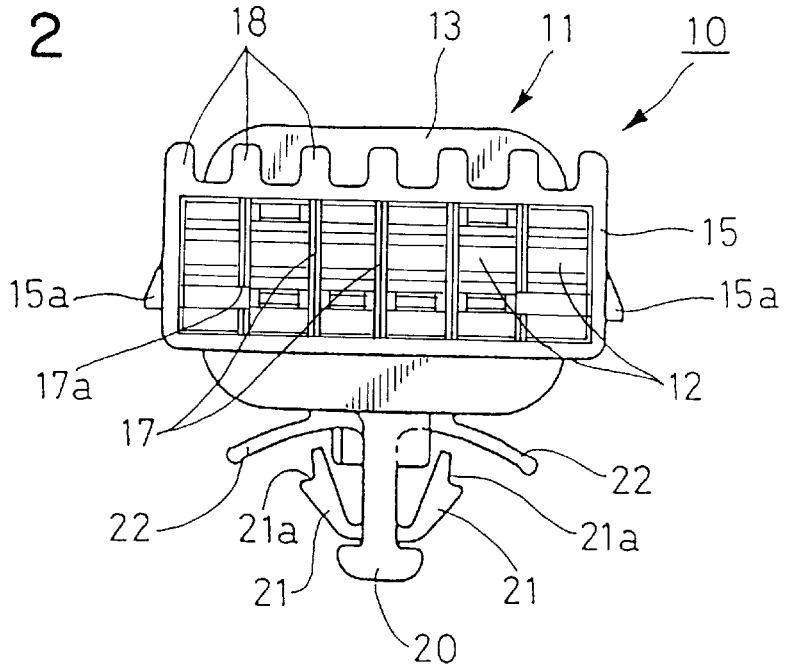
FIG. 2 is a rear view of a housing of the connector of FIG. 1.
Figure 3:
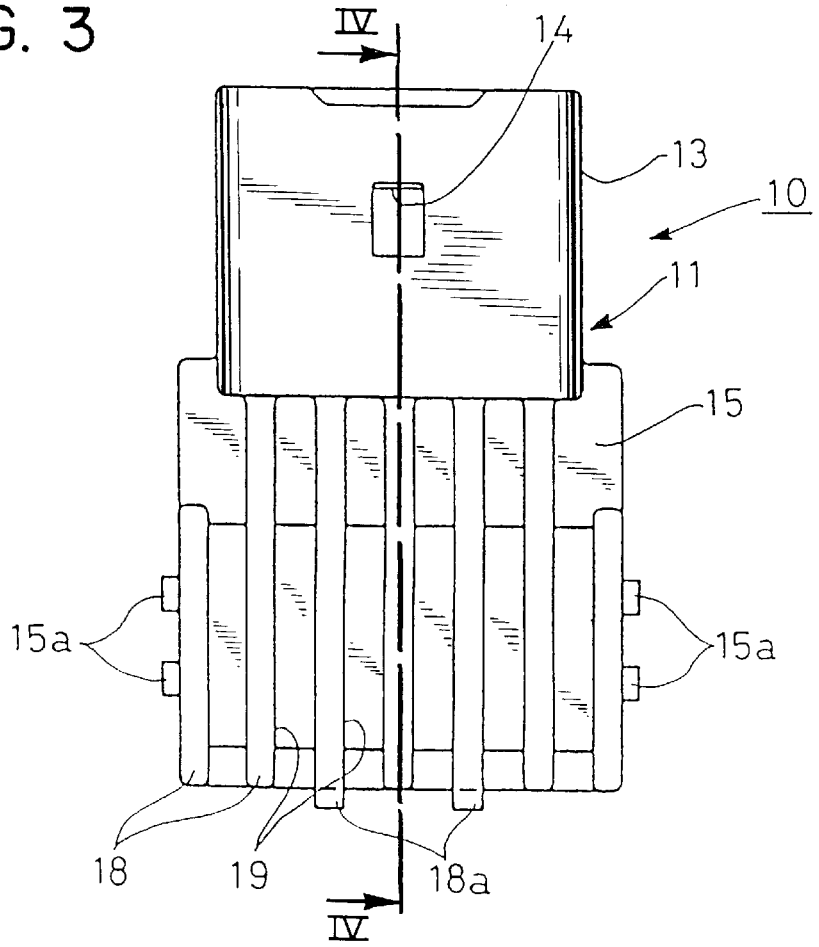
FIG. 3 is a plan view of the housing of the connector of FIG. 1.

As shown in FIG. 2, the terminal insertion member 15 has six cavities 12 arranged laterally in a row. These are partitioned by means of separating walls 17 formed between the cavities 12. Furthermore, slits 17*a* are formed in the separating walls 17 located at the left and right extreme ends. The slits 17*a* extend from the posterior end to an appropriate depth and serve to permit laterally displaced terminal fittings to be installed.

As shown in FIG. 4, projections 18 are formed on the upper face of the housing 11 so as to pass along each cavity 12. Moreover, slit shaped openings or recesses 19 are formed between the projections 18. The openings 19 respectively connect with the cavities 12 and are formed so as to extend along a specified length. A specified length of the electric wires 50 can be inserted from these openings 19 into the cavities 12.

A cover 40 is attached on the housing 11 and covers the openings 19 so as to prevent removal of the electric wires 50 when installed. The cover 40 is also composed in a unified manner of plastics and has a downward-facing C-shape (see FIGS. 5 and 6). This cover 40 completely covers the openings 19 and is formed so as to fit with the upper face and both the sides faces of the housing 11. Both the sides of the cover 40 are bendable slightly in the sideways direction. Furthermore, two vertically extending attachment recesses 41 are formed in the centre of each side of the cover 40. These recesses 41 correspond to fitting projections 15*a* that project in a parallel manner from both side faces of the terminal insertion member 15 of the housing 11. When the cover 40 is fitted with the housing 11, these fitting projections 15*a* respectively fit with the lower extreme ends of the recesses 41. Further, in the present embodiment, two claw members 42 are formed on the central portion of the posterior end of the upper face of the cover 40. The claw members 42 face downwards and serve to strengthen the fitting force of the cover 40, and elastically fit with latch members 18*a* formed at the posterior end of the corresponding projections 18 in the housing 11 (FIG. 1).

Six cleats or legs 40*a* are formed on the rear face of the cover 40, corresponding to the pitch of each opening 19 between the projections 18. Each cleat 40*a* has a thickness that allows it to be inserted into the opening or recess 19, and is formed so as to support the electric wire 50 along a specified length by pushing it down from above, the electric wire 50 being supported by the terminal fitting 43. Furthermore, cut-away portions 40*b* are formed so as to prevent interference with pressure crimping slits of the terminal fittings, now described.

A press crimp terminal fitting 43, made from an electrically conducting metal plate, will now be described. The first embodiment uses three kinds of terminal fittings 43A, 43B and 43C. Each type has a tab 44 (fitting connection member) that allows the terminal fitting of the corresponding female connector to be fitted thereon. The opposite side has a press crimping connection member 45 for press crimping and fixing the electric wire 50. In the press crimping connection member 45, a press crimping slit 46 is formed so as to face upwards and serves to press-crimp in place the electric wire 50 that extends along the lengthwise direction of the tab 44. It is arranged so that the press crimping slit 46 can break or cut the covering of the electric wire 50 and can crimp the core thereof. Moreover, the terminal fitting 43 is inserted into the corresponding cavity 12 from the tab 44 side, and is held firmly in place by being inserted into the through hole 16*a* of the partitioning plate 16.

Among the three types of terminal fittings 43A, 43B and 43C used in the present embodiment, the terminal fitting 43A is a straight type terminal fitting wherein the tab 44 and the press crimping connection member 45 are located on the same plane on the same straight line. The terminal fitting 43B is a horizontal shift type terminal fitting wherein the portion medially located between the tab 44 and the press crimping connection member 45 has a horizontally displaced portion 47. The terminal fitting 43C is a vertical shift type terminal fitting wherein the portion medially located between the tab 44 and the pressure crimping connection member 45 has a vertically displaced portion 48. In the present embodiment, the displacement is a distance sufficient that the corresponding female terminals (not shown) located one above the other do not interfere with each other.

The displaced portions 47, 48 can be considered as being lateral with respect to the generally longitudinally extending tabs 44 and press crimping connection members 45.

Figure 7:
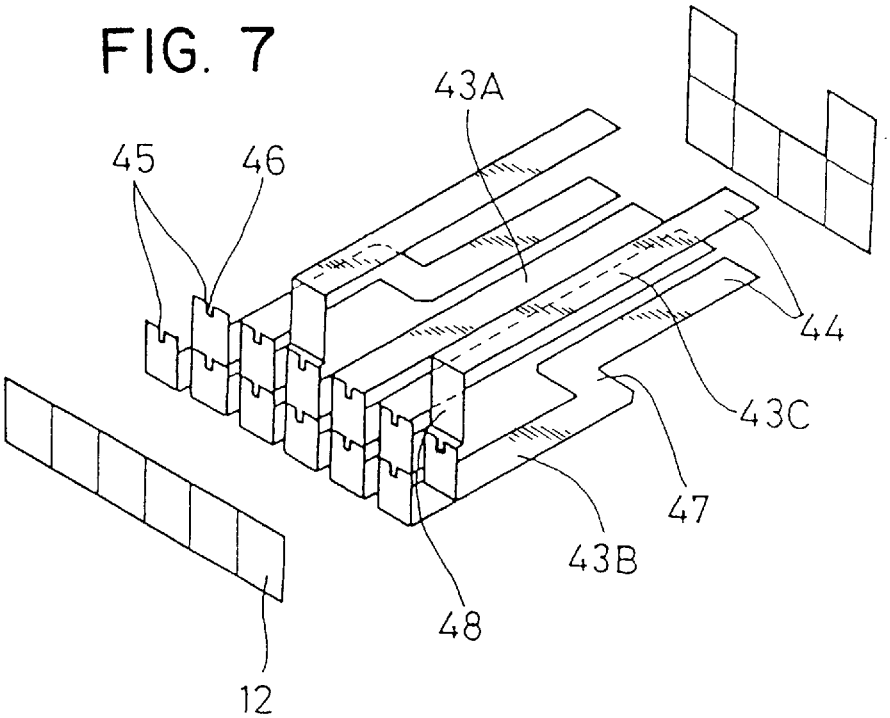
FIG. 7 is a schematic diagram showing the arrangement of terminal fittings in the connector of FIG. 1.
Figure 8:
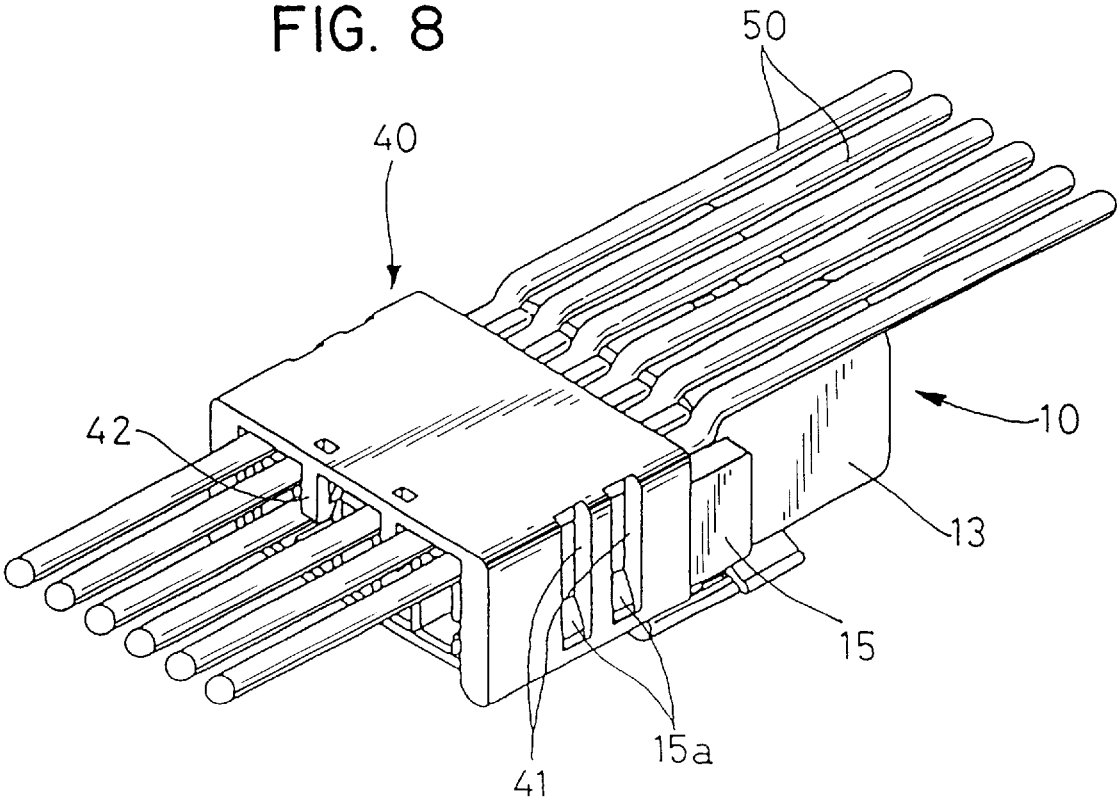
FIG. 8 is a perspective view of the connector of FIG. 1 having wires installed therein.
Figure 9:
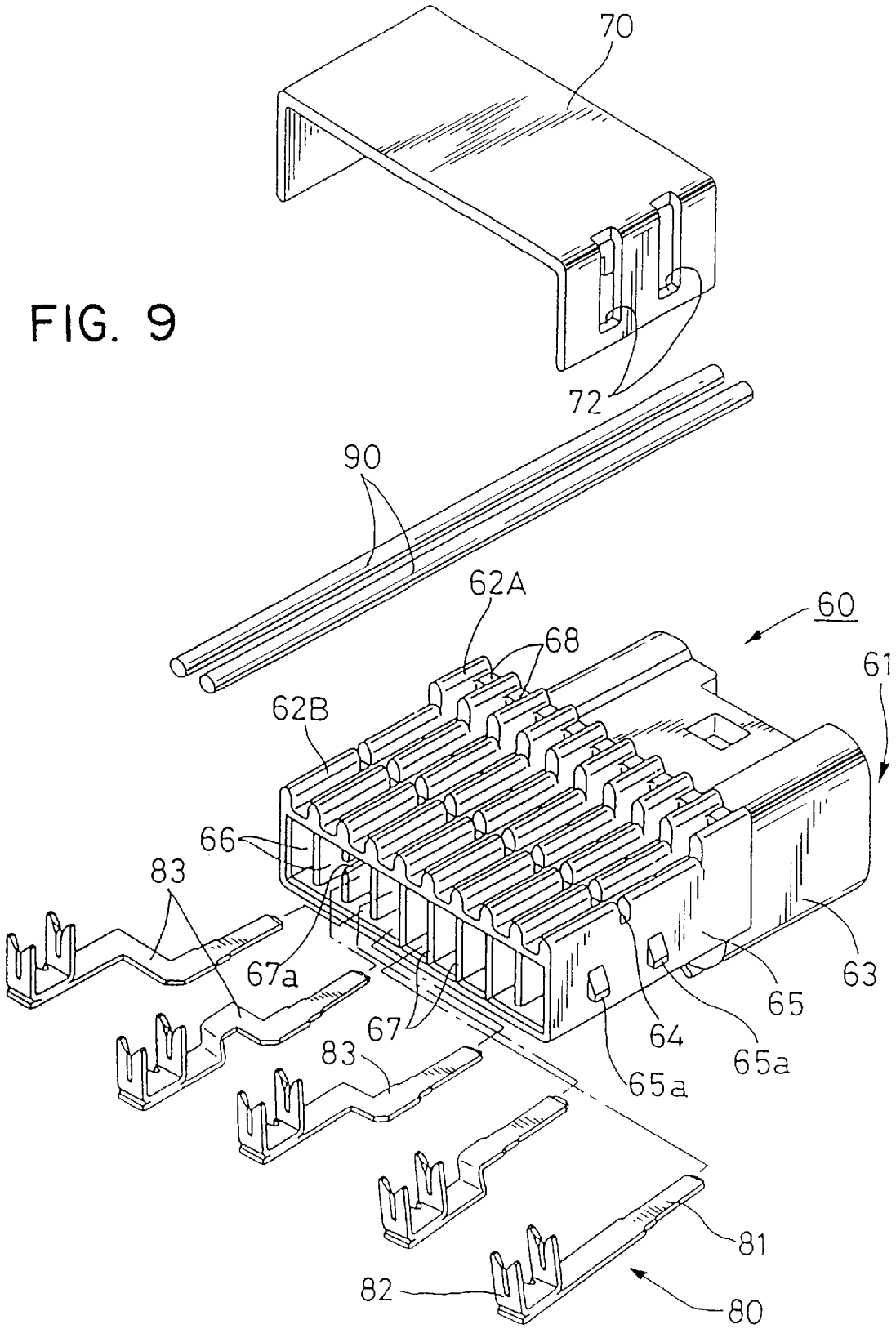
FIG. 9 is a perspective view of a connector according to a second embodiment of the invention in an exploded state.

These three types of terminal fittings 43A, 43B and 43C are arranged as shown in FIG. 7. That is, the tabs 44 on both the left and right sides of the terminal fittings 43 are located on upper and lower levels, and among them the tabs 44 located on the upper level belong to the vertical shift type terminal fitting, and the tabs 44 located on the lower level belong to the horizontal shift type terminal fittings which are displaced laterally in an outwards direction. Furthermore, the two rows of tabs 44 located between the upper and lower layers are arranged at the lower level and belong to the straight type terminal fittings. As a result, the terminal fittings 43 are respectively and separately housed in the corresponding cavities 12 in the terminal insertion member 15 of the housing 11, and all of them are arranged in a horizontal direction so their heights are the same.

The operation of the first embodiment, configured as described above, will now be explained. Each terminal fitting 43 is inserted into the corresponding cavity 12, resulting in the arrangement illustrated in FIG. 7. Then, the electric wires 50 are arranged along each of the cavities 12 and inserted slowly between each of the projections 18. Thereafter, the electric wires 50 are pushed into the cavities 12 via the openings 19, using a press crimping device (not shown). Although the terminal fittings 43 are arranged in upper and lower levels, within the terminal insertion member 15 the terminal fittings 43 are arranged in a uniform manner in the horizontal, lateral direction, and so the press crimping operation with respect to all the terminal fittings 43 is carried out in one step. In that way, when each of the electric wires 50 is inserted into the press crimping slits 46, the covering of each of the electric wires is broken and a connection with the inner wire core is achieved.

Next, when the cover 40 is fitted so as to cover the openings 19 of the housing 11, both the attachment grooves 41 respectively fit with the fitting projections 15*a*. Simultaneously, both the claw members 42 fit with the corresponding convex members 18*a*. Accordingly, the cover 40 is firmly fixed in place with respect to the housing 11. As a result, each electric wire 50 is pushed from the rear face of the cover 40, thereby ensuring that the removal of the electric wire 50 is prevented.

Further, in this kind of connector 10, the clip 20 thereof is pushed into the attachment hole of the fixing wall face. Accordingly, the claw members 21*a* fit with the edges of the attachment hole, and the spring members 22 press against the periphery of the hole, thereby strengthening the fitting force of the claw members 21*a*. As a result, the connector 10 as a whole is firmly fixed to the fixing wall face.

As described above, according to the first embodiment, even though there is an upper and lower level arrangement of the terminal fittings 43 on the side of the hood 13, on the terminal insertion member 15 side the height of the terminal fittings 43 can be arranged to be the same along a lateral direction. Consequently, the press crimping operation can be carried out in one step via the openings 19. For this reason, assembly productivity can be improved and the terminal fittings 43 need not be arranged in a zigzag manner as is necessary in the conventional case; this results in achieving miniaturization of the connector.

FIGS. 9 to 19 show a second embodiment of the present invention. In this case, the application to a nine-terminal type press crimp connector is shown. The basic configuration is the same as that of the first configuration, and explanation of the parts similar to those in the first embodiment is omitted.

A housing 61 of a connector 60 relating to the present embodiment has projections 62 which are partitioned into three parts in an anterior-posterior direction. The projection height of projections 62A located closer to a hood 63 and towards the outer side of openings or recesses 69 is higher than that of projections 62B located posteriorly with respect to the projections 62A. The spaces between these projections 62A which have a higher projection height function as temporary supporting grooves 68 for electric wires 90. That is, when the electric wires 90 are arranged in a parallel manner above the housing 61, a portion of each of the electric wires 90 enters smoothly into the spaces (the temporary supporting grooves 68) between the projections 62A which have a higher projection height. Accordingly, each electric wire 90 can be kept in a temporarily supported state with respect to the housing 61 (see FIG. 18). Moreover, the central portion of the projections 62B, which are at a lower projection height, have cut-away concave grooves 64 extending along their central portions in the width-wise direction in order to receive a strengthening rib 71 (FIG. 13), formed on the underside of the cover 70, when the cover 70 is attached.

A terminal insertion member 65 of the housing 61 has nine cavities 66 formed laterally in a row. Moreover, as shown in the diagram, among separating walls 67 located between the cavities 66, the second separating wall 67 from the left in FIG. 9 has a cut-away slit 67A formed therein so as to permit a vertically displaced terminal fitting to be installed. Furthermore, all the three separating walls from the left and the separating wall on the right in FIG. 9 have spaces of specified dimensions formed between their lower ends and the base surface. These spaces serve to allow the insertion of horizontally displaced members 83 of the terminal fitting 80.

The cover 70 is C-shaped as in the case of the first embodiment, and is attachable to the housing 61 so as to cover the projections 62B, which are at a lower height, and both the side faces. Although the second embodiment is similar to the first in that two attachment grooves 72 are provided so as to fit with fitting projections 65*a* of the housing 61, claw members that were present in the first embodiment are omitted. In the second embodiment, instead of using claw members, the following is provided.

Figure 14:
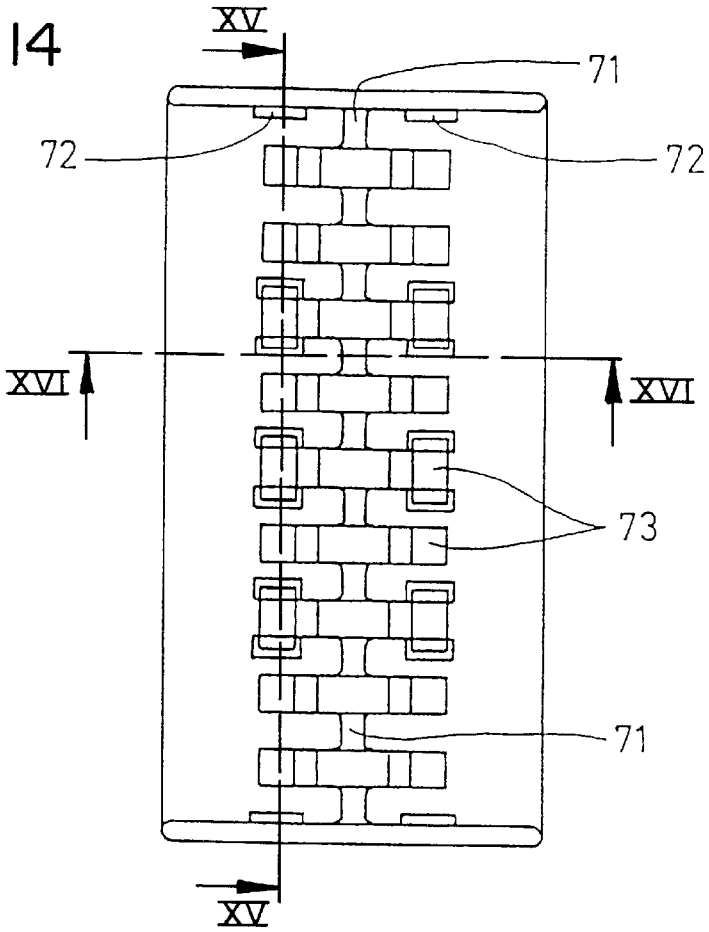
FIG. 14 is a view of the underside of a cover of the connector of FIG. 9.
Figure 15:
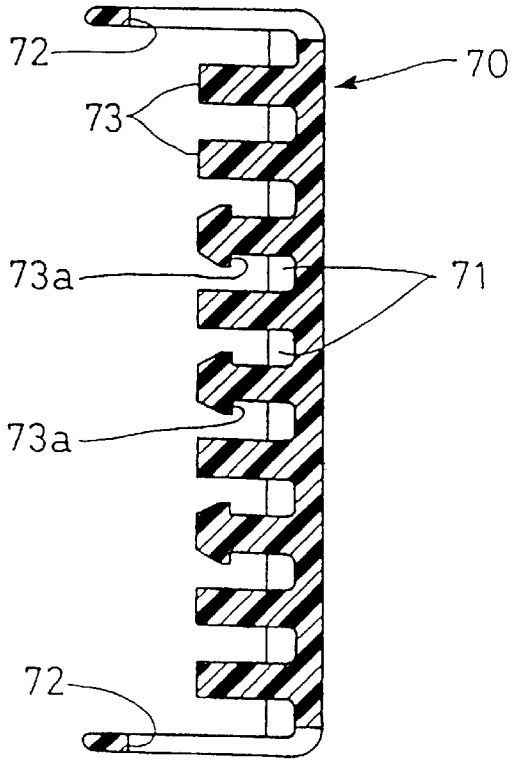
FIG. 15 is a cross-sectional view of the cover along line XV—XV indicated in FIG. 14.
Figure 16:
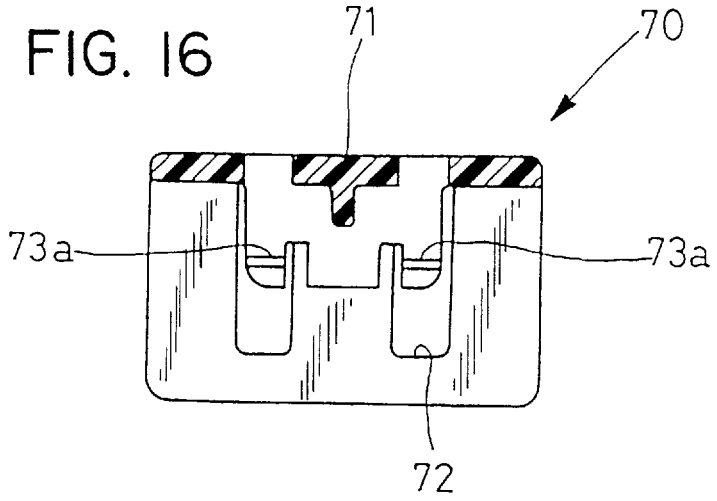
FIG. 16 is a cross-sectional view of the cover along line XVI—XVI indicated in FIG. 14.

As shown in FIGS. 14 to 16, the rear face of the cover 70 has the strengthening rib 71 formed so as to project in the central portion in a width-wise direction. The strengthening rib 71 is provided in order to prevent warping, since the second embodiment has nine terminals which is a greater number than that used in the first embodiment. Furthermore, the strengthening rib 71 has a plurality of cleats or legs 73 corresponding to the pitch of the openings or recesses 69. These cleats 73 project so as to branch out in the anterior and posterior directions. Moreover, three removal-prevention claws 73*a* located alternately in the central portion project in a width-wise direction. Each of these removal-preventing claws 73A enters the openings 69 when the cover 70 is attached and fits with the lower face of the corresponding projections 62B. Accordingly, a firm fitting of the cover 70 is achieved due to the combined fitting of the attachment grooves 72 and the fitting projections 65*a*.

The cover 70 is reversible unlike the prior art; this can eliminate the possibility of incorrect assembly.

The terminal fitting 80 used in the second embodiment is basically the same as the one used in the first embodiment, but in addition, a horizontal shift type terminal fitting that shifts only in the horizontal direction, and not vertically, is used. Further, two kinds of horizontal shift type terminal fittings are provided; one of these is displaced horizontally by one cavity-unit, and the other is displaced horizontally by two cavity-units.

Figure 10:
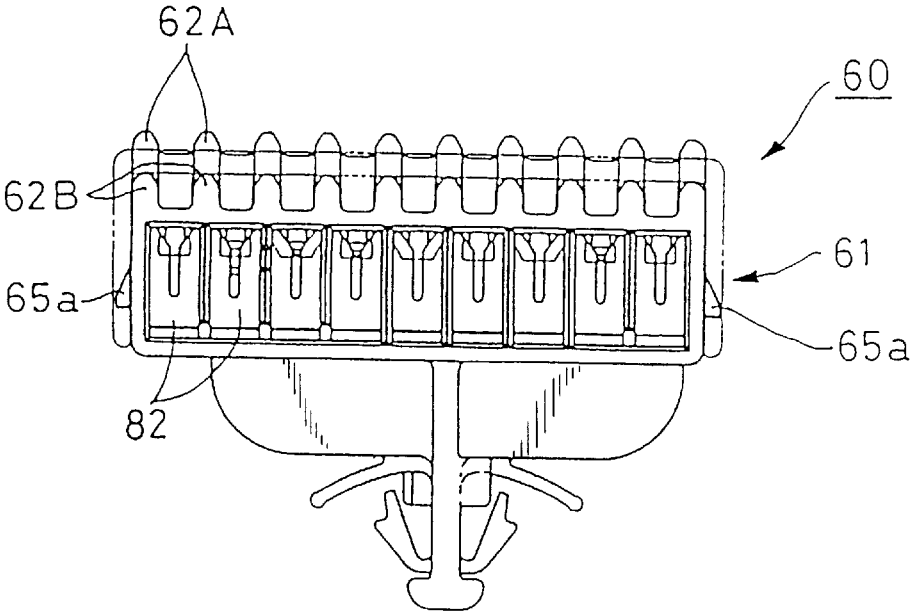
FIG. 10 is a rear view of a housing of the connector of FIG. 9.
Figure 11:
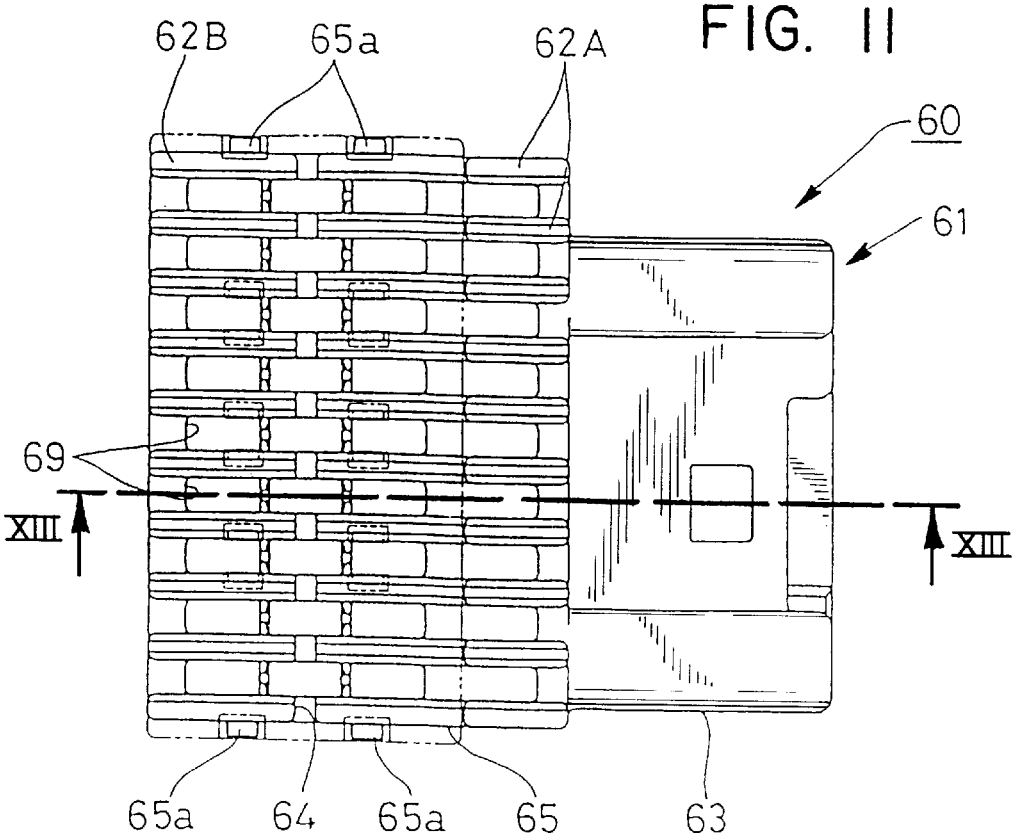
FIG. 11 is a plan view of the housing of the connector of FIG. 9.
Figure 12:
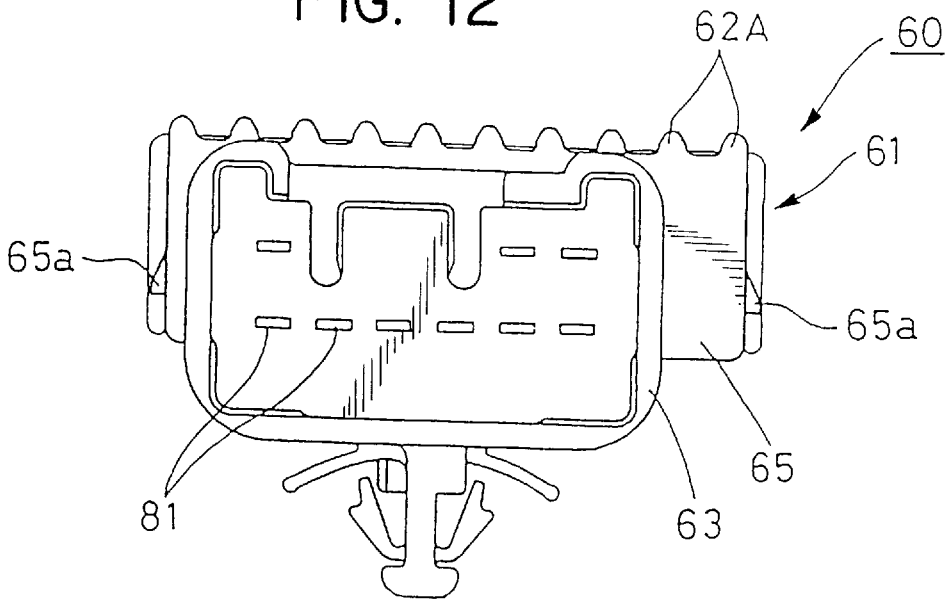
FIG. 12 is a front view of the housing of the connector of FIG. 9.
Figure 13:
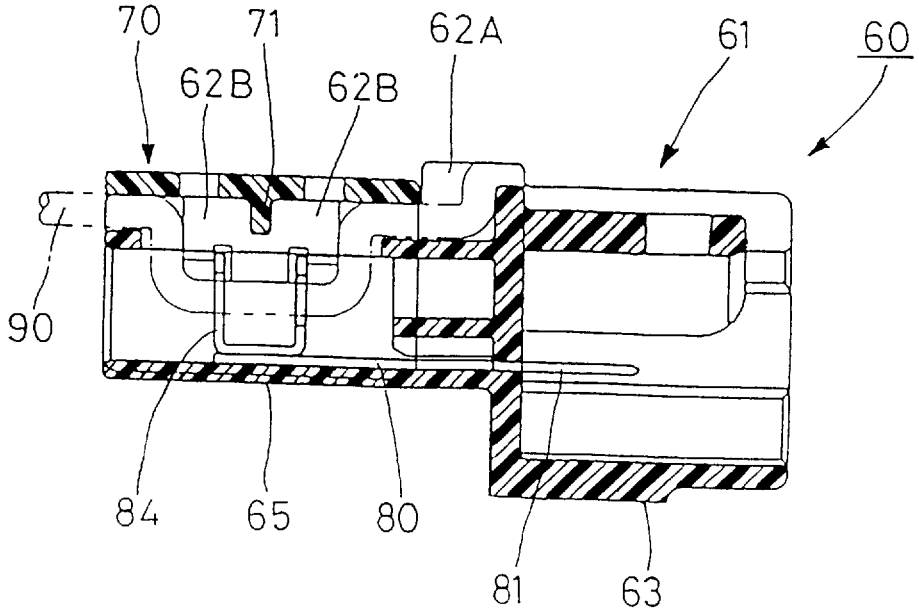
FIG. 13 is a cross-sectional view of the housing along line XIII—XIII indicated in FIG. 10.
Figure 17:
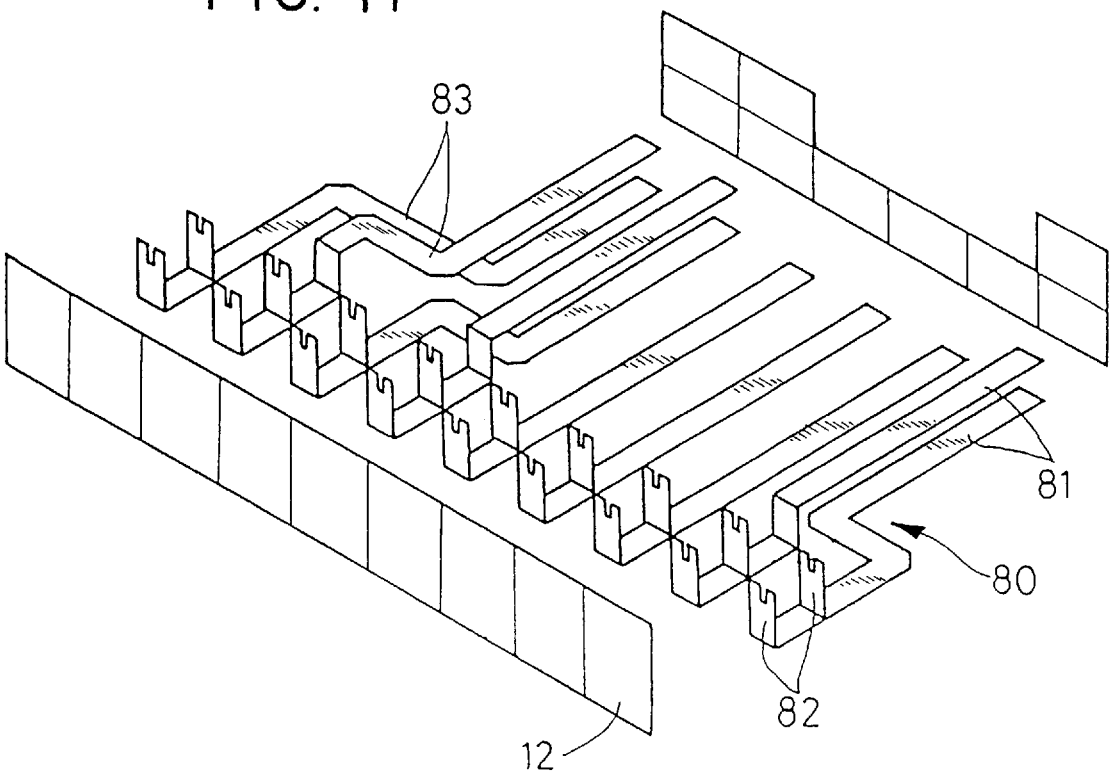
FIG. 17 is a schematic diagram showing the arrangement of terminal fittings in the connector of FIG. 9.
Figure 18:
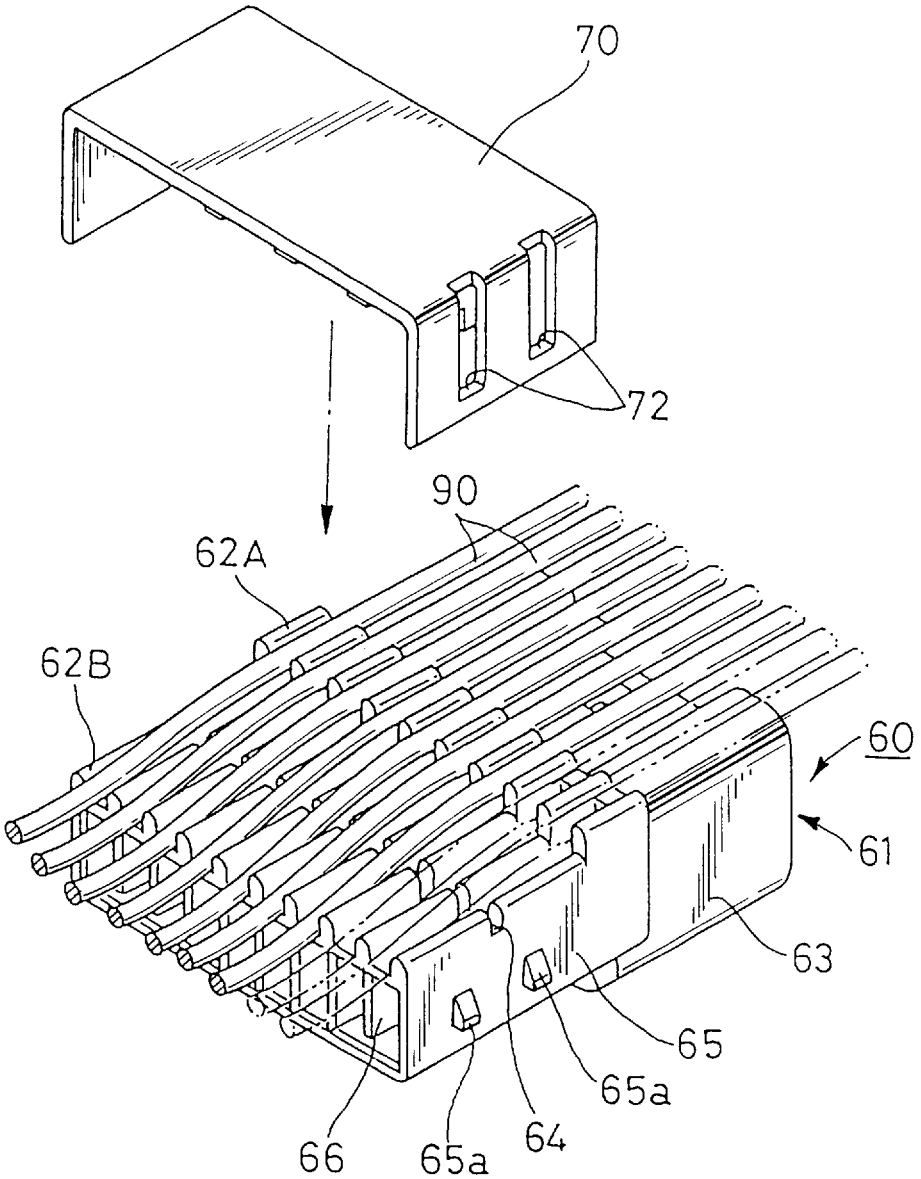
FIG. 18 is a perspective view of the connector of FIG. 9 showing wires temporarily supported therein.

The arrangement of the terminal fittings 80 is as shown in FIG. 17. That is, when the corresponding types of terminal fittings 80 are inserted into the respective cavities 66 as shown in the diagram, in spite of the fact that the arrangement of the tabs 81 toward the hood 63 side is in six rows that are composed of an upper layer and a lower layer (excluding the third, fourth and fifth tabs 81 from the right), as shown in FIG. 10, on the terminal insertion member 65 side, all the press crimp connection members 82 of the terminal fittings 80 are laterally aligned with respect to all the cavities 66; that is, all the press crimp connection members 82 of the terminal fittings 80 have the same height.

The second embodiment being configured as described above, each terminal fitting 80 is inserted into the specified cavity 66, and the arrangement is as shown in FIG. 17. Next, nine electric wires 90 are arranged so as to be aligned in an anterior-posterior direction with respect to the housing 61, and are placed between the projections 62 (see FIG. 18). At this juncture, each electric wire 90 fits into the respective temporary fitting groove 68 and is held in a temporarily supported state due to the fitting strength of the temporary fitting groove 68, thereby preventing inadvertent slippage of the electric wire 90.

Thereafter, the electric wires 90 are pushed into each cavity 66 via the openings 69 using a press crimping device (not shown). As in the case of the first embodiment, since the press crimp connection members 82 of all the terminal fittings 80 are arranged to be at the same height, the press crimping operation with respect to the terminal fittings 80 can be carried out in one go, and accordingly the press crimping operation can be performed efficiently.

Next, the cover 70 is fitted over the upper face of the housing 61. The strengthening rib 71 of the cover 70 fits with the cut-away convex groove 64 and each cleat 73 enters the cavity 66 via the openings 69 to hold down and support the corresponding electric wire 90. Each fitting projection 65a fits with the corresponding attachment groove 72 and the removal-preventing claws 73*a* are pushed into the openings 69 and fit with the edges thereof. Accordingly, due to this fitting of the cover 70 with the housing 61, the cover 70 is firmly fixed to the housing 61. Consequently, the support of the electric wires 90 is carried out with certainty (see FIG. 19).

Several variations are possible in the present invention, and the variations described below also lie within the technical range of the present invention.

(1) Although in both the embodiments described above, the tabs are arranged to be in an upper and lower layer, there may equally be three or more layers, and in that sense the number of terminals of the connector is not limited.

(2) Although in both the embodiments, the application to a male connector is described, application to a female connector is equally possible.

(3) Although in the second embodiment the depth of the temporary supporting grooves is set to be approximately the same as the external diameter of the electric wires, these may equally be formed to be deeper. If this is done, even in the case where the wall face approaches the cover side of the housing, the peak of the projections forming the temporary support grooves merely make contact with this wall face and interference between the electric wire and the wall face can be avoided. Consequently, abrasion of the electric wire can be prevented from the very outset.

I claim:

1. A connector comprising a housing and a plurality of terminals received in the housing, each of the terminals comprising an elongate first portion for making contact with another connector, and an elongate second portion having walls defining an upstanding slot to receive an electrical conductor by pressure crimping, said slot having a longitudinal axis along which the conductors extend in a first direction, the first and second portions being substantially parallel to the first direction, a first of said terminals further comprising a medial portion between the first and second portions thereof and substantially transverse with respect thereto, such that the first and second portions of said first terminal are non-linear, and a second of said terminals comprising co-linear first and second portions, the second portions of each of said terminals in said housing being aligned in a single row extending substantially perpendicular to said first and second portions and in a plane substantially parallel to said first and second portions, and the first portions of said terminals lying in a plurality of planes substantially parallel to said first and second portions.

2. A connector according to claim 1 wherein the medial portion extends at right angles to said first and to said second portions.

3. A connector according to claim 2 wherein said medial portion is straight.

4. A connector according to claim 1 wherein said housing surrounds said second portion, said housing having an elongate opening defined therein over said second portion.

5. A connector according to claim 4 wherein the walls of said elongate opening are parallel walls, and said walls extend outwardly of said housing on either side of said opening.

6. A connector according to claim 5 wherein the outward extensions of said walls extend laterally and are longer than said opening.

7. A connector according to claim 6 wherein said walls are continuous.

8. A connector according to claim 5 wherein said walls are continuous.

9. A connector according to claim 1 wherein said housing has two or more insertion recesses therein, each insertion recess being adapted to receive one of said terminals.

10. A connector according to claim 9 wherein each recess has a substantially continuous partition wall with a neighbouring recess, at least one partition wall being slotted to receive said medial portion.

11. A connector according to claim 1 and further including a cover for said second portion, the cover having latch means engageable with said housing for retention thereon.

12. A connector according to claim 11 wherein said housing is substantially rectangular and said cover is substantially 'U' shaped and engages said housing on opposite sides thereof.

13. A connector according to claim 12 wherein said cover includes an internal stiffening rib extending perpendicularly to the axis of said second portion, and said housing includes a depression for engagement by said rib.

14. A connector according to claim 13 wherein said cover further including one or more depending legs, and said housing has one or more corresponding leg recesses for engagement by said one or more legs.

15. A connector according to claim 14 wherein said legs include lock means for engagement with said housing.

16. A connector according to claim 15 wherein at least one of said legs is engageable in use with an electrical conductor crimped to said second portion.

17. A connector according to claim 14 wherein at least one of said legs is engageable in use with an electrical conductor crimped to said second portion.

* * * * *